US005307662A

United States Patent [19]

Tsuzuki

[11] Patent Number: 5,307,662

[45] Date of Patent: May 3, 1994

[54] ROLL THREADING APPARATUS FOR THREADING END BLANK FOR METAL DRUM CONTAINER

[75] Inventor: Toshio Tsuzuki, Kanagawa, Japan

[73] Assignee: Tannan Co., Ltd., Kanagawa, Japan

[21] Appl. No.: 989,373

[22] Filed: Dec. 11, 1992

[30] Foreign Application Priority Data

Dec. 11, 1991 [JP] Japan ..... 3-327430

[51] Int. Cl.[5] ..... B21H 3/08

[52] U.S. Cl. ..... 72/91; 72/103

[58] Field of Search ..... 72/91, 117, 123, 103, 72/104

[56] References Cited

U.S. PATENT DOCUMENTS

| | | | |
|---|---|---|---|
| 1,083,598 | 1/1914 | Douglas | 72/91 |
| 2,019,493 | 11/1935 | Hothersall | 72/91 |
| 2,242,662 | 5/1941 | Shera | 72/103 |
| 2,271,762 | 2/1942 | Draper | 72/103 |
| 3,760,561 | 9/1973 | Over et al. | 53/201 |
| 4,397,593 | 8/1983 | Fordeck | 409/179 |
| 4,399,679 | 8/1983 | King | 72/117 |
| 4,420,959 | 12/1983 | King | 72/113 |
| 4,439,082 | 3/1984 | King | 413/56 |
| 4,462,235 | 7/1984 | King | 72/103 |
| 4,540,100 | 9/1985 | Willis | 212/252 |

FOREIGN PATENT DOCUMENTS 1333964 10/1973 United Kingdom .

*Primary Examiner*—Lowell A. Larson
*Attorney, Agent, or Firm*—Paul A. Guss

[57] ABSTRACT

A turntable for supporting an end blank having a tubular flange integral therewith is rotatable about an axis of the tubular flange. An annular threading roll die rotatable with the turntable receives therein the flange of the end blank with a full outer circumferential surface of the tubular flange being held against the annular threading roll die. The annular threading roll die has a first inner threading surface for threading the tubular flange. A threading roll is inserted into the tubular flange of the end flange supported on the turntable in spaced relationship to an inner circumferential surface of the tubular flange. The threading roll is rotatable and movable toward the inner circumferential surface of the tubular flange, and has a second inner threading surface which is complementary to the first threading surface. In operation, the threading roll die is rotated through the turntable and the threading roll is also rotated in synchronism with each other in the same direction, and the threading roll is moved toward the threading roll die to press the threading roll against the inner circumferential surface of the tubular flange while the threading roll die and the threading roll are being rotated. While the first and second threading surfaces are being rotated, they are pressed against the tubular flange to thread the tubular flange.

5 Claims, 3 Drawing Sheets

ROLL THREADING APPARATUS FOR THREADING END BLANK FOR METAL DRUM CONTAINER

BACKGROUND OF THE INVENTION

1. Field of the Invention

The present invention relates to a roll threading apparatus for threading a tubular flange around an aperture defined in an end blank for use on a metal drum container.

2. Description of the Prior Art

Heretofore, it has been customary in the metal drum container industries to thread a tubular flange, which is separate from an end blank for use on a metal drum container, to form internal threads for engaging a plug, and then attaching the threaded flange to the end blank. Roll threading has been used to thread such tubular flanges.

Recently, it has been proposed to produce end blank with integral tubular flanges. However, threading tubular flanges that are integral with end blanks by way of roll threading cannot be performed by conventional roll threading apparatus because the end blank, which is relatively heavy, has to be rotated together with the tubular flange. Accordingly, it is necessary to thread tubular flanges integral with end blanks by way of tapping. When a tubular flange is tapped, however, the mechanical strength of the flange is lowered, and chips need to be removed.

SUMMARY OF THE INVENTION

It is therefore an object of the present invention to provide a roll threading apparatus of simple structure which is capable of highly accurately threading an end blank for use on a metal drum container.

To achieve the above object, there is provided in accordance with the present invention a roll threading apparatus for threading an end blank for use on a metal drum container, comprising a turntable for supporting an end blank having a tubular flange integral therewith, the turntable being rotatable about an axis of the tubular flange, an annular threading roll die rotatable with the turntable for receiving therein the flange of the end blank with a full outer circumferential surface of the tubular flange being held against the annular threading roll die, the annular threading roll die having a first threading surface on a full inner circumference thereof for threading the tubular flange, a threading roll disposed for insertion into the tubular flange of the end flange supported on the turntable in spaced relationship to an inner circumferential surface of the tubular flange, the threading roll being rotatable and movable toward the inner circumferential surface of the tubular flange, the threading roll having a second threading surface on a full inner circumference thereof which is complementary to the first threading surface, rotating means for rotating the threading roll die through the turntable and the threading roll in synchronism with each other in the same direction, and pressing means for moving the threading roll toward the threading roll die to press the threading roll against the inner circumferential surface of the tubular flange while the threading roll die and the threading roll are being rotated by the rotating means, the arrangement being such that while the first and second threading surfaces are being rotated, the first and second threading surfaces are pressed against the tubular flange to thread the tubular flange.

To thread the tubular flange of the end blank, the end blank is first placed on the turntable with the tubular flange inserted in the threading roll die. The full outer circumferential surface of the tubular flange is held against the first threading surface of the threading roll die, and the inner circumferential surface of the tubular flange faces the threading roll.

Then, the turntable is rotated with the threading roll die, and the threading roll is rotated in synchronism therewith by the rotating means.

Thereafter, the threading roll is moved toward the inner circumferential surface of the tubular flange to press the second threading surface against the first threading surface through the tubular flange, which is sandwiched between the first and second threading surfaces. Upon rotation of the threading roll and the threading roll die, the tubular flange is pressed at continously varying positions between the first and second threading surfaces, and threaded thereby.

Since the end blank is securely supported on the turntable for threading the tubular flange, the tubular flange can be threaded highly accurately. Since the tubular flange is threaded by roll threading, the mechanical strength of the threaded tubular flange is higher than would be if it were threaded by tapping. Furthermore, it is not necessary to remove chips which would otherwise be produced if the tubular flange were tapped.

The rotating means comprises a first driven gear mounted on a hollow shaft on which the turntable is mounted, a drive shaft extending parallel to the hollow shaft, a drive motor for rotating the drive shaft, a first drive shaft mounted on the drive shaft for rotating the first driven gear, a second drive gear mounted on the drive shaft, a rotatable shaft extending parallel to the drive shaft and inserted through the hollow shaft, the rotatable shaft being radially movable, the threading roll being mounted on the rotatable shaft, and a second driven gear mounted on the rotatable shaft and rotatable by the second drive gear at the same speed in the same direction as the first driven gear.

The pressing means comprises a swing member supporting the rotatable shaft with the second driven gear in mesh with the second drive gear, the swing member being swingable about an axis of the drive shaft, and swinging means for swinging the swing member into a position in which the threading roll presses the tubular flange against the threading roll die.

The rotatable shaft has an end supporting the threading roll and an opposite end supported on an intermediate portion of the swing member, the second driven gear being mounted on the opposite end of the rotatable shaft, the second driven gear being held in mesh with the second drive gear for being rotated thereby.

The swing member is mounted on an end of the swing member, the swinging means being coupled to an end of the swing member remote from the end thereof.

The first threading surface of the threading roll die is internally threaded, and the second threading surface of the threading roll is externally threaded.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
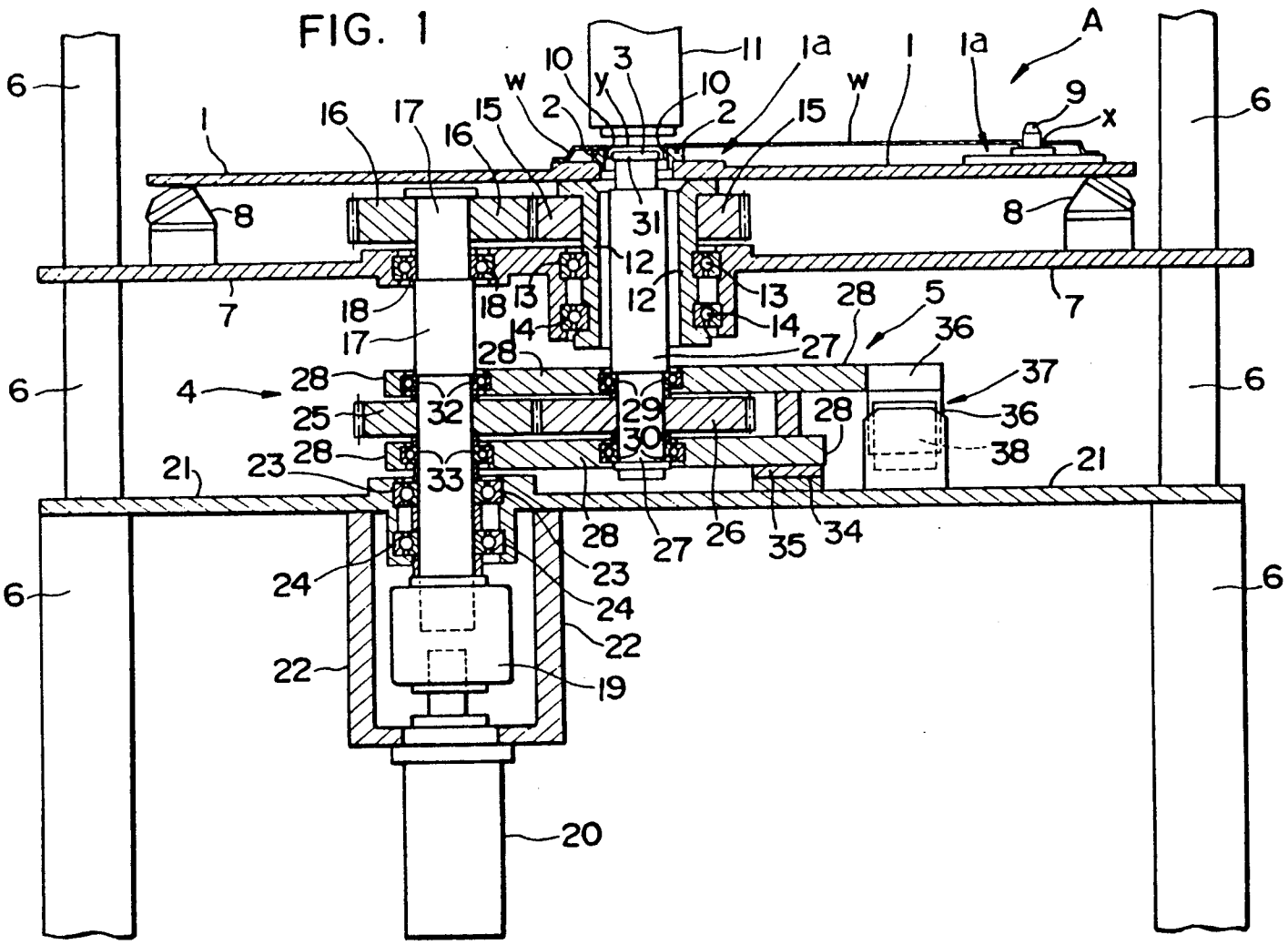
FIG. 1 is a vertical cross-sectional view of a roll threading apparatus according to the present invention.

As shown in FIG. 1, a roll threading apparatus A generally comprises a turntable 1 for supporting an end blank w for a metal drum container, an annular threading roll die 2 mounted on the turntable 1, a threading roll 3 disposed in the annular threading roll die 2 in spaced relationship thereto, a rotating mechanism 4 for rotating the turntable 1 and the threading roll 3 in synchronism with each other, and a pressing mechanism 5 for pressing the threading roll 3 toward a threaded inner surface of the annular threading roll die 2.

The turntable 1, which is in the shape of a disk, has its circumferential edge rotatably supported on support rollers 8 mounted on a first support member 7 which is supported on columns 6. The turntable 1 has central and outer end blank supports 1*a* for supporting the end blank w upside down with the reverse side thereof facing upwardly. The outer end blank support 1*a*, which is positioned in a radially outer position on the turntable 1, has a fixing pin 9 for being inserted in an opening x defined in the end blank w for thereby securing the end blank w with respect to the turntable 1.

The annular threading roll die 2 is mounted on the central end blank support 1*a* that is located at the center of the turntable 1. When the end blank w is supported on the central end blank support 1*a*, a tubular flange y of the end blank w is inserted in the annular threading roll die 2. The annular threading roll die 2 has a first inner threading surface 10 on its full inner circumference which is internally threaded for threading the tubular flange y. Directly above the annular threading roll die 2, there is disposed a rotatable holder 11 which is lowered by a lifting and lowering mechanism (not shown) when the end blank w is placed on the turntable 1, for pressing the end blank w against the annular threading roll die 2 to support the end blank w securely on the turntable 1.

The rotating mechanism 4 will be described below. The rotating mechanism 4 has a hollow rotatable shaft 12 extending downwardly from the turntable 1 in coaxial relationship thereto. The hollow shaft 12 is rotatably supported on the first support member 7 by bearings 13, 14. The hollow shaft 12 supports thereon a first driven gear 15 held in mesh with a first drive gear 16 that is mounted on the upper end of a rotatable drive shaft 17 extending parallel to the hollow shaft 12. The drive shaft 17 extending downwardly through the first support member 7, and is rotatably supported on the first support member 7 by a bearing 18. The drive shaft 17 is coupled at its lower end to a drive motor 20 through a joint 19. The drive motor 20 is fixed by a frame 22 to a second support member 21 that is supported on the columns 6 and positioned below and parallel to the first support member 7. The drive shaft 17 extends downwardly through the second support member 21, and is rotatably supported thereon by bearings 23, 24.

The drive shaft 17 supports thereon a second drive gear 25 which has the same diameter as the first drive gear 16 so that the second drive gear 25 rotates at the same speed as the first drive gear 16. The drive gear 25 is held in mesh with a second driven gear 26 that is rotatable at the same speed in the same direction as the first driven gear 15. The second driven gear 26 is mounted on a lower end portion of an upwardly extending rotatable shaft 27. The lower end of the rotatable shaft 27 is rotatably supported by bearings 29, 30 on a pair of vertically spaced, upper and lower swing members 28 of the pressing mechanism 5 at longitudinally central positions thereon. The rotatable shaft 27 extends through the hollow shaft 12, and supports the threading roll 3 on its upper end. The threading roll 3 has a second outer threading surface 31 on its full outer circumference which is externally threaded complementarily to the first inner threading surface 10.

The pressing mechanism 5 will be described below. The swing members 28 which are connected to each other are swingably supported at ends on the drive shaft 17 by respective bearings 32, 33. The lower swing member 28 has on its other end a slider 35 slidable along a guide 34 mounted on the second support member 21 and extending along the direction in which the swing members 28 move. The upper swing member 28 has an outwardly extending coupling 36 that is connected to a swing mechanism 37.

Figure 2:
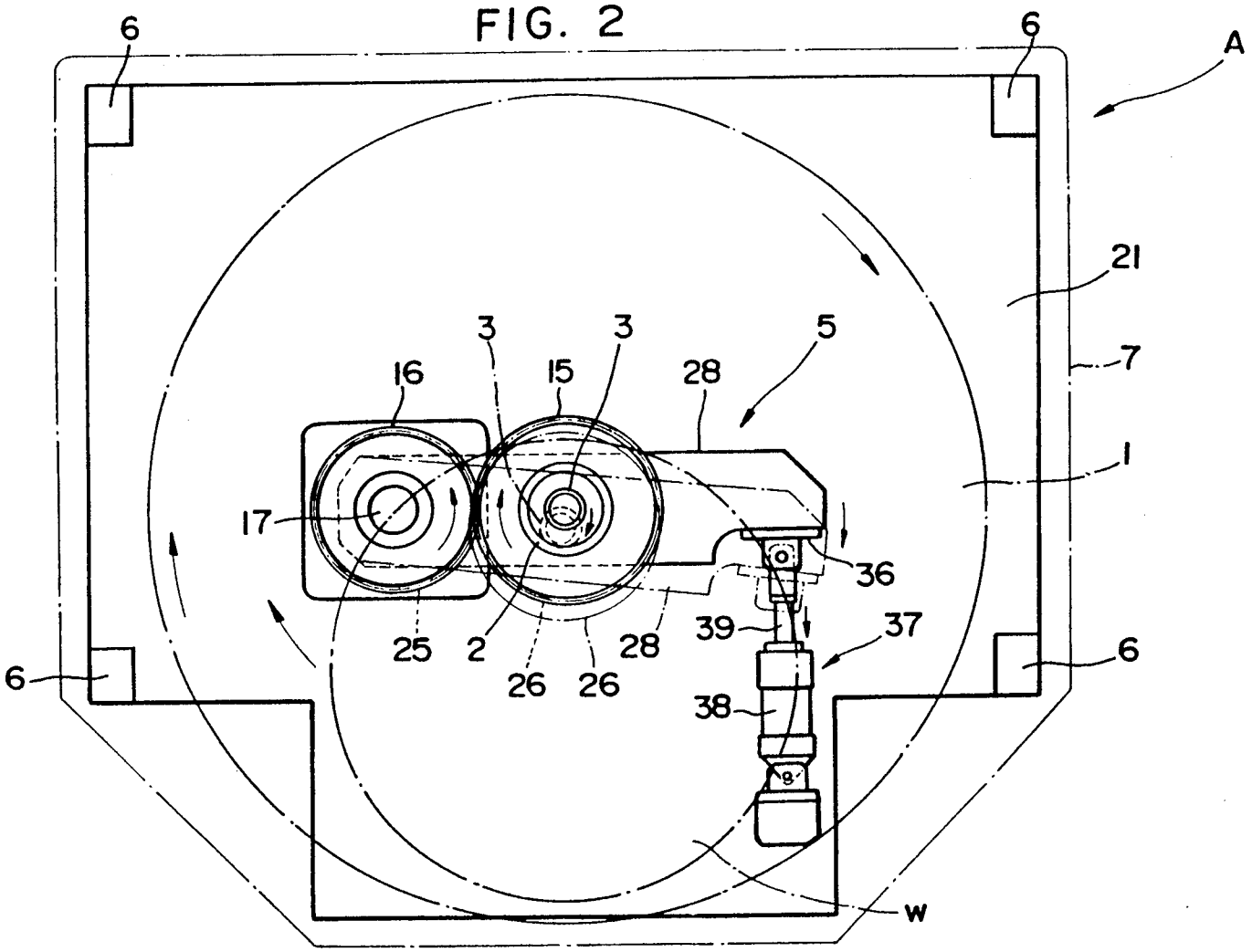
FIG. 2 is a plan view of the roll threading apparatus, showing the manner in which it operates.

As shown in FIG. 2, the swing mechanism 37 comprises a cylinder unit 38 mounted on the second support member 21 and having a piston rod 39 movable into and out of the cylinder. The coupling 36 of the upper swing member 28 is connected to a distal end of the piston rod 39.

When the piston rod 39 extends or contracts, the swing members 28 swing about the drive shaft 17 while the second drive gear 25 is meshing with the second driven gear 26. Therefore, the threading roll die 2 and the threading roll 3 can be kept in synchronous rotation, and the structure for synchronizing the rotation of the threading roll die 2 with the rotation of the threading roll 3 is relatively simple.

Upon swinging movement of the swing members 28, the shaft 27 of the threading roll 3 swings with the second driven gear 26 to move the threading roll 3 into contact with an inner circumferential surface of the flange y that is inserted in the threading roll die 2. The threading roll 3 can be pressed against the inner circumferential surface of the flange y by the cylinder unit 38.

Figure 3:
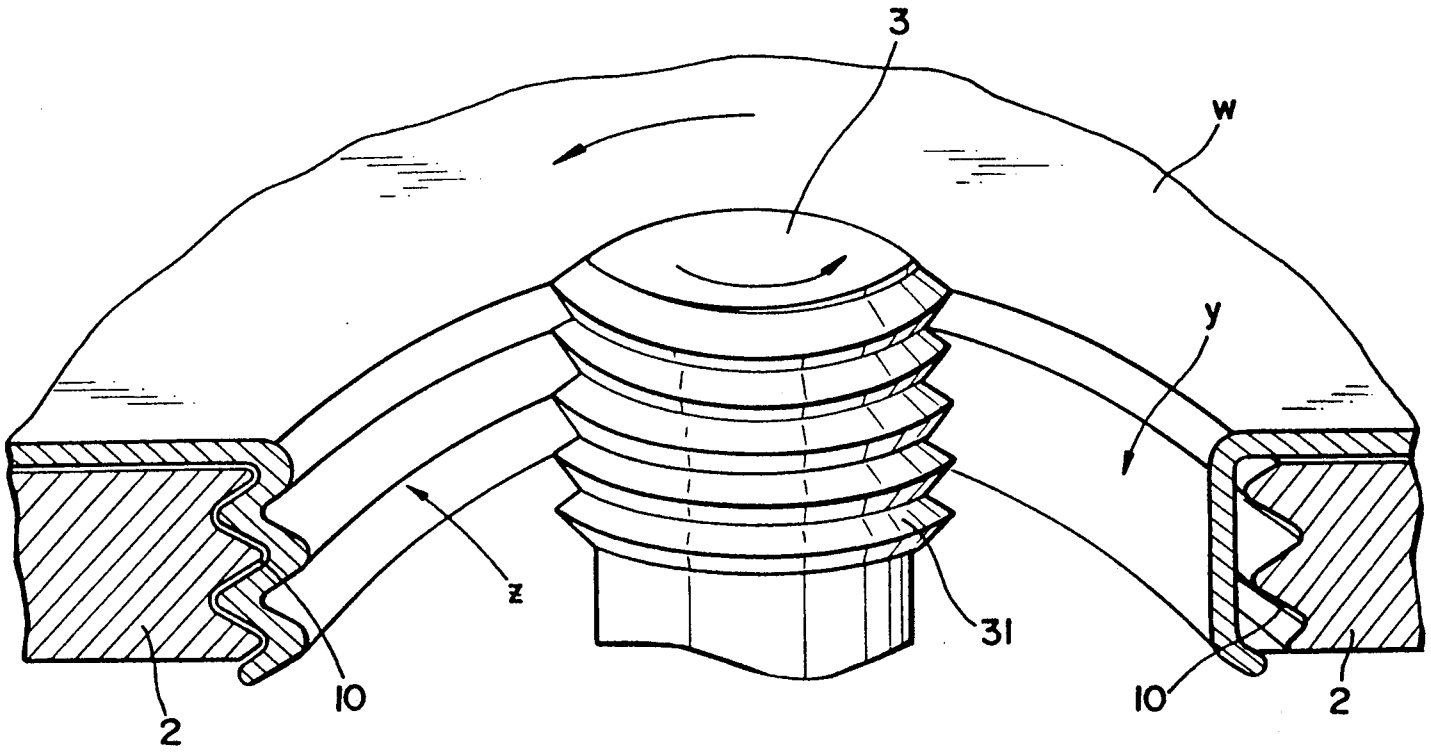
FIG. 3 is an enlarged fragmentary perspective view showing the manner a tublar flange on an end blank is threaded by the roll threading apparatus.

The roll threading apparatus A operates as follows:

First, the end blank w is supported on the turntable 1. At this time, as shown in FIG. 3, the tubular flange y on the end blank w is inserted in the treading roll die 2 with the full outer circumferential surface of the flange y being held against the first threading surface 10.

Then, the drive motor 20 is energized to rotate the drive shaft 17. Since the first and second drive gears 16, 25 are mounted on the drive shaft 17 for rotation at the same speed, the turntable 1 and the threading roll die 2 are rotated by the first driven gear 15, and the threading roll 3 is rotated by the second driven gear 26 in synchronism with each other in the same direction. At this time, the end blank w is rotated about the center of the flange y by the turntable 1.

Thereafter, as shown in FIG. 2, the piston rod 39 of the cylinder unit 38 is retracted, i.e., contracted, to move the threading roll 3 toward the threading roll die 2. The threading roll 3 is now swung while the second drive gear 25 and the second driven gear 26 are being held in mesh with each other.

The cylinder unit 38 is continuously operated to press the second threading surface 31 of the threading roll 3 against the inner surface of the flange y which is in turn pressed against the first threading surface 10 of the threading roll die 2. Since the threading roll 3 and the threading roll die 2 are rotating, they are pressed against each other at continuously varying positions. Though the threading roll 3 and the threading roll die 2 are rotating at the same speed, because the threading roll 3 has an outside diameter smaller than the inside diameter of the threading roll die 2, the peripheral speed of the threading roll die 2 is greater than the peripheral speed of the threading roll 3. As a result, the first and second threading surfaces 10, 31 rotate in varying relative positions, jointly threading the flange y in pressing engagement therewith.

While the first driven gear 15 and the first drive gear 16 are held in direct mesh with each other and the second driven gear 26 and the second drive gear 25 are held in direct mesh with each other in the illustrated embodiment, they may be held in mesh with each other through idler gears interposed therebetween.

Although a certain preferred embodiment of the present invention has been shown and described in detail, it should be understood that various changes and modifications may be made therein without departing from the scope of the appended claims.

What is claimed is:

1. A roll threading apparatus for threading a substantially circularly shaped end blank for use on a metal drum container, said end blank having a tubular flange integrally formed therein such that an axis of the tubular flange is disposed at a position displaced from a center of said end blank, comprising:

a turntable for supporting said end blank, said turntable being rotatable about an axis of the tubular flange such that said circularly shaped end blank is rotated eccentrically on said turntable;

an annular threading roll die mounted on said turntable and rotatable with said turntable about the axis of said tubular flange, said annular threading roll die receiving therein the flange of the end blank such that a full outer circumferential surface of the tubular flange is held against an inner circumferential surface of the annular threading roll die, said annular threading roll die having a first threading surface on the full inner circumferential surface thereof for threading the tubular flange;

a threading roll disposed for insertion into the tubular flange of the end blank supported on said turntable in spaced relationship to an inner circumferential surface of the tubular flange, said threading roll being rotatable and movable toward the inner circumferential surface of the tubular flange, said threading roll having a second threading surface on a full outer circumference thereof which is complementary to said first threading surface;

rotating means for rotating said annular threading roll die through said turntable and said threading roll in synchronism with each other in the same direction; and pressing means for moving said threading roll toward said annular threading roll die to press said threading roll against the inner circumferential surface of said tubular flange while said annular threading roll die and said threading roll are being rotated by said rotating means;

the arrangement being such that while said first and second threading surfaces are being rotated, the first and second threading surfaces are pressed against the tubular flange to thread the tubular flange.

2. A roll threading apparatus according to claim 1, wherein said turntable has a hollow shaft, said rotating means comprising:

a first driven gear mounted on said hollow shaft;

a drive shaft extending parallel to said hollow shaft;

a drive motor for rotating said drive shaft;

a first drive shaft mounted on said drive shaft for rotating said first driven gear;

a second drive gear mounted on said drive shaft;

a rotatable shaft extending parallel to said drive shaft and inserted through said hollow shaft, said rotatable shaft being radially movable, said threading roll being mounted on said rotatable shaft; and a second driven gear mounted on said rotatable shaft and rotatable by said second drive gear at the same speed in the same direction as said first driven gear, and wherein said pressing means comprises:

a swing member supporting said rotatable shaft with said second driven gear in mesh with said second drive gear, said swing member being swingable about an axis of said drive shaft; and swinging means for swinging said swing member into a position in which said threading roll presses the tubular flange against said threading roll die.

3. A roll threading apparatus according to claim 2, wherein said rotatable shaft has an end supporting said threading roll and an opposite end supported on an intermediate portion of said swing member, said second driven gear being mounted on said opposite end of said rotatable shaft, said second driven gear being held in mesh with said second drive gear for being rotated thereby.

4. A roll threading apparatus according to claim 3, wherein said swing member is pivotally mounted at one end thereof, said swing means being coupled to another end of said swing member remote from said one end thereof.

5. A roll threading apparatus according to claim 1, wherein said first threading surface of said threading roll die is internally threaded, and said second threading surface of said threading roll is externally threaded.

* * * * *